US009126809B2

(12) United States Patent
Christen

(10) Patent No.: US 9,126,809 B2
(45) Date of Patent: Sep. 8, 2015

(54) DEVICE AND METHOD FOR CONTROLLING ELEVATOR CAR DOOR

(75) Inventor: Jules Christen, Altdorf (CH)

(73) Assignee: Inventio AG, Hergiswil (CH)

( * ) Notice: Subject to any disclaimer, the term of this patent is extended or adjusted under 35 U.S.C. 154(b) by 790 days.

(21) Appl. No.: 13/394,908

(22) PCT Filed: Sep. 15, 2010

(86) PCT No.: PCT/EP2010/063509

§ 371 (c)(1),
(2), (4) Date: Mar. 8, 2012

(87) PCT Pub. No.: WO2011/032955

PCT Pub. Date: Mar. 24, 2011

(65) Prior Publication Data

US 2012/0168259 A1 Jul. 5, 2012

(30) Foreign Application Priority Data

Sep. 18, 2009 (EP) ..... 09170764

(51) Int. Cl.
*B66B 13/14* (2006.01)
*B66B 19/00* (2006.01)

(52) U.S. Cl.
CPC ..... *B66B 13/143* (2013.01); *B66B 19/007* (2013.01)

(58) Field of Classification Search
CPC ..... B66B 13/02; B66B 13/06; B66B 13/08; B66B 13/143; B66B 13/24; B66B 19/007
USPC ..... 187/247, 313, 316, 317, 391, 393; 49/26, 28; 318/466–470
See application file for complete search history.

(56) References Cited

U.S. PATENT DOCUMENTS

| | | | | |
|---|---|---|---|---|
| 4,926,975 | A | 5/1990 | Morris | |
| 5,317,934 | A * | 6/1994 | Zannis | 74/40 |
| 5,378,861 | A * | 1/1995 | Barten et al. | 187/316 |
| 5,384,439 | A * | 1/1995 | Ernecke et al. | 187/316 |
| 5,587,565 | A | 12/1996 | Schroder-Brumloop et al. | |
| 5,587,566 | A * | 12/1996 | Barten et al. | 187/316 |
| 5,625,175 | A * | 4/1997 | Gutknecht et al. | 187/316 |
| 5,804,779 | A * | 9/1998 | Fargo | 187/316 |
| 5,841,083 | A * | 11/1998 | Schonauer et al. | 187/316 |
| 5,859,395 | A * | 1/1999 | Fargo | 187/316 |
| 6,452,353 | B1 * | 9/2002 | Calamatas | 318/466 |

(Continued)

FOREIGN PATENT DOCUMENTS

| | | |
|---|---|---|
| EP | 0383087 A1 | 8/1990 |
| EP | 0976675 A1 | 2/2000 |

(Continued)

*Primary Examiner* — Anthony Salata
(74) *Attorney, Agent, or Firm* — Fraser Clemens Martin & Miller LLC; William J. Clemens

(57) ABSTRACT

An elevator car has an access opening, a car door for closing the access opening, which door has at least one door panel that can be displaced parallel to the access opening, a thrust crank drive for displacing the at least one door panel between an open position and a closed position, an electric motor for driving the thrust crank drive, and a control device for actuating the electric motor. The control device actuates the electric motor so that a displacement velocity of the at least one door panel is substantially constant over the entire displacement path between the open position and the closed position of the door panel.

16 Claims, 1 Drawing Sheet

(56) References Cited

U.S. PATENT DOCUMENTS

| | | | | |
|---|---|---|---|---|
| 6,481,533 | B1 * | 11/2002 | Iwasa | 187/296 |
| 6,943,508 | B2 * | 9/2005 | Morris et al. | 318/38 |
| 7,637,355 | B2 * | 12/2009 | Tyni | 187/316 |
| 7,681,695 | B2 * | 3/2010 | Christen | 187/319 |

FOREIGN PATENT DOCUMENTS

| | | | |
|---|---|---|---|
| EP | 0677475 | B1 | 6/2000 |
| JP | 2204293 | A | 8/1990 |
| JP | 6171871 | A | 6/1994 |
| JP | 2002302369 | A | 10/2002 |

* cited by examiner

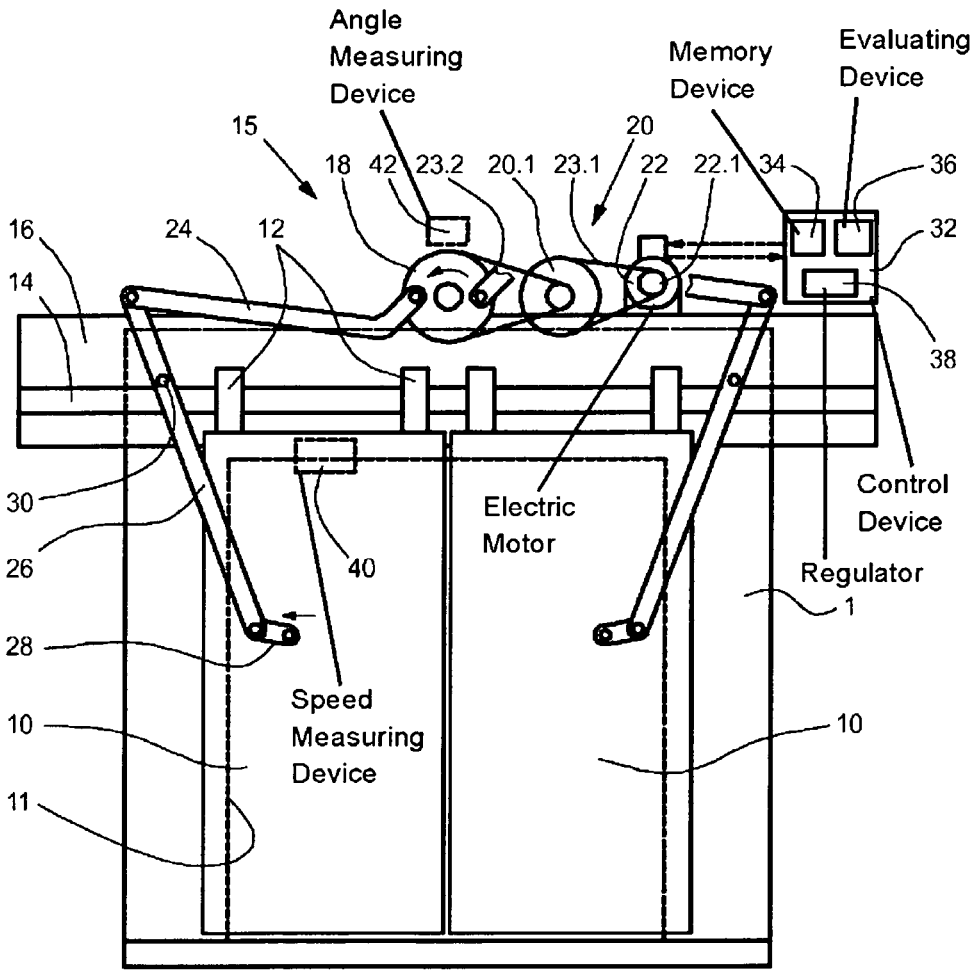
Angle
Measuring
Device
Memory
Device
Evaluating
Device
15
20
18
42
23.2
20.1
23.1
22
22.1
34
36
16
24
12
32
14
38
30
Control
Device
Electric
Motor
26
40
Regulator
1
28
Speed
Measuring
Device
10
10
11

DEVICE AND METHOD FOR CONTROLLING ELEVATOR CAR DOOR

FIELD

The present invention relates to an elevator car of an elevator installation and a method of modernizing an elevator car, particularly the door drive thereof.

BACKGROUND

Such an elevator car includes, inter alia, an access opening, a car door for closing the access opening, wherein the car door has at least one door panel displaceable parallel to the access opening, a thrust crank drive for moving the at least one door panel between an open setting and a closed setting, an electric motor for driving the thrust crank drive and a control device for controlling the electric motor.

EP 0 677 475 B1 discloses a method of controlling an elevator door, wherein an elevator door is brought from one extreme setting to another extreme setting and phase or directional data resulting from the movement step are stored. The movement of the elevator door is carried out at a constant, preselected speed, whilst pulses generated by an incremental coder are counted.

A method for force limitation for automatic elevator doors is known from EP 0 976 675 A1. In that case a plot of the drive force to be employed in operation which is free of a disturbance force is determined by means of a mathematical model for the door drive and compared with the drive force plot produced by the door drive. Departures therefrom can lead to stopping of the door.

EP 0 383 087 A1 describes an elevator car with an elevator door with several door panels. Door drive arms are provided which are parts of a thrust crank drive and driven by an electric motor via a drive disc.

SUMMARY

It is an object of the present invention to create an improved elevator car with a car door and a door drive comprising a thrust crank drive in which the closing or opening times are minimized, wherein, in particular, the maximum kinetic energy present in the door panels during the closing process does not exceed a permissible value.

A further object of the invention consists in indicating a method of modernizing an elevator car with a car door and a door drive comprising a thrust crank drive, which method leads to an elevator car with a door drive in which the closing and opening times are minimized, wherein, in particular, the maximum kinetic energy present in the door panels during the closing process does not exceed a permissible value.

The elevator car has an access opening which can be closed by a car door. The car door comprises at least one door panel displaceable parallel to the access opening. The at least one door panel can be moved between an open setting and a closed setting by a thrust crank drive. An electric motor for driving the thrust crank drive is provided and can be controlled by means of a control device. According to the invention the control device is so constructed that it can control the electric motor in such a manner that the movement speed of the at least one door panel is substantially constant over the entire movement path between the open setting and the closed setting of the door panel.

By "substantially constant" there is to be understood in that case that, in particular, compensation is provided for the irregularities, which are caused by the kinematics of the thrust crank drive, in the movement and the door panels are closed or opened at a speed remaining at least approximately the same. Unaffected by that is a specific acceleration or deceleration of the door panels in the vicinity of the extreme position of the door panels, namely the positions in which the car door is completely closed or completely open. It will be obvious that a constant speed cannot prevail in the vicinity of the extreme positions, since a stop is always connected with a speed change present over at least a short time. Moreover, regardless of the substantially constant speed of the door panels a smooth starting off or retardation of the door panels can be provided without departure from the subject of the invention. To that extent there is preferably meant by the term "entire movement path" that movement path in which the door panel is already accelerated to an operating speed or before the door panel is again braked from this operating speed.

In the case of a constant rotational speed of the electric motor the kinematics of the thrust crank drive of a conventional elevator car cause, depending on the instantaneous setting of a thrust crank drive, varying translation ratios which have the consequence of a non-uniform movement of the door panels. Apart from that, the changing translation ratios also produce, notwithstanding constant torque delivered by the electric motor, differences in the maximum actuation force able to be exerted on the door panels by the thrust crank drive.

According to the invention compensation for the non-uniform movement is now provided by the control in accordance with the invention of the rotational speed of the electric motor. In regions of crank arm settings in which at constant rotational speed of the electric motor a more-than-average speed of the door panel would result, the rotational speed of the electric motor is reduced and in regions of crank arm settings in which at constant rotational speed of the electric motor a less-than-average speed of the door panel would result, the rotational speed of the electric motor is increased.

In advantageous manner, the elevator car of the invention combines the advantages of a conventional thrust crank drive for the door panels (i.e. defined end positions, simpler construction, etc.) with the advantages of an intelligent control of the electric motor, i.e. with the advantages of a substantially constant speed of the moved door panel. Shorter closing and opening times for the door panels can thereby be achieved without the maximum permissible kinetic energy in the moved door panel being exceeded.

In one of the forms of embodiment of the invention the control device is so constructed that it can control the electric motor in such a manner that the maximum actuation force able to be exerted by the thrust crank drive on the at least one door panel is substantially constant over the entire movement path between the open setting and the closed setting of the door panel. In regions of crank arm settings in which at constant torque delivered by the electric motor an excessively high maximum actuation force able to be exerted on the door panel would result, the maximum producible torque of the electric motor is reduced with consideration of the instantaneous kinematic ratios. Equally, in regions of crank arm settings in which at constant torque, which is delivered by the electric motor, of the electric motor a too-small maximum exertable actuation force would result, the maximum producible torque of the electric motor is increased with consideration of the instantaneous kinematic ratios. It is thereby ensured that an impermissibly high actuation force cannot be exerted on the door panel in any setting of the thrust crank drive, so that passengers trapped by the closing door panel cannot be injured.

In a further form of embodiment of the invention the control device comprises a memory device for storage of a predetermined rotational speed plot for the electric motor over the entire movement path between the open setting and the closed setting of the door panel. The predetermined rotational speed plot then produces in conjunction with the changing translation of the thrust crank drive a substantially constant speed of movement of the at least one door panel over the entire movement path thereof.

Alternatively to or in combination with the afore-described form of embodiment the memory device can also be constructed for storage of the translation ratios, which vary in dependence on the setting of the thrust crank drive, of the thrust crank drive over the entire movement path. With knowledge of the translation ratio associated with every setting of the thrust crank drive the required rotational speed of the electric motor can be calculated in order to achieve a desired movement speed of the door panel for every instantaneous setting of the thrust crank drive. This applies analogously to the maximum actuation force able to be exerted on the door panel. A desired maximum exertable actuation force can with knowledge of the respective translation ratios associated with an instantaneous setting of the thrust crank drive or a position of the movement path be recomputed into a respective maximum permissible motor drive torque associated with an instantaneous setting.

In a further embodiment of the invention an evaluating device which can detect a deviation between an actual motor variable and a motor variable required for the predetermined rotational speed plot can be additionally provided. By "motor variables" there are meant in that case, in particular, state variables of a motor which can refer to a rotational speed or a motor drive torque: A motor variable of that kind can be, for example in the case of a direct-current drive, for the rotational speed plot the plot of the armature voltage; for the plot of the torque, this can be, in particular, the plot of the armature current.

The control device is in that case preferably constructed in such a manner that in the case of a detected departure of a specific variable, particularly a state variable of the motor, the movement of the door panel is stopped or reversed. This can be of advantage particularly when the movement of the door panel is blocked by an obstacle, for example a person, trapped by the door panel. In that case the door panel can—if at all—be moved on only slowly. Due to the blocking and the torque increase required for maintenance of the rotational speed there is a rise in, for example, the armature amperage in the case of a direct current drive, which can be recognized by the evaluating device. With observation optionally of further parameters the door can then be stopped and/or accelerated in the opposite direction so as to enable re-opening of the door panel or freeing of a trapped person.

In a further form of embodiment of the invention a speed measuring device for detection of a movement speed of the at least one door panel is provided. A speed measuring device of that kind can comprise, for example, a travel measuring sensor which can pick up a change in travel. With consideration of the time unit necessary in that case the movement speed can be averaged at least in a section of the movement path. Moreover, such a speed measuring device can also be formed by an acceleration sensor. A conclusion about the current movement speed of, in particular, a door panel can be made by integral formation of an acceleration averaged plot over a time unit.

In this case the control device preferably further comprises an adaptation device for adaptation of the predetermined rotational speed plot for the electric motor during operation of the elevator car on the basis of the detected movement speed of the at least one door panel. The adaptation device particularly serves the purpose of also actually maintaining the rotational speed plot, which is predetermined. For this purpose the adaptation device can change state variables of the electric motor such as, for example, the armature amperage.

In a further form of embodiment of the invention an angle measuring device for detection of at least one angular position of at least one component of the thrust crank drive is provided. A component of the thrust crank drive can be, in particular, a crank wheel, a connecting arm or a door drive arm. The angular position can in that case be an absolute angular position of the corresponding component relative to the vertical or the horizontal. However, the angular position can also be the relative angular position of a component with respect to another component of the elevator car, particularly another component of the thrust crank drive, particularly of the respective other arm. It is advantageous if—as described in the foregoing—conclusions about the translation of the thrust crank drive in dependence on the instantaneous setting of the thrust crank drive are possible by way of the angular position. A conclusion about the necessary motor rotational speed or about permissible motor torque can be made from this translation.

The control device is preferably constructed in such a manner that a regulation of the motor torque and/or the motor rotational speed of the electric motor is provided in dependence on the angular position detected by the angle measuring device. The angular position thus represents an input magnitude of the regulation of the motor rotational speed and/or of the maximum permissible motor torque. The control device then, strictly speaking, takes over the tasks of a regulating device.

In a further embodiment of the invention the control device can be a programmable control device. In that case the control device can be programmable with an algorithm which in the determination of the instantaneous motor rotational speed and/or the instantaneous motor torque of the electric motor can take into consideration the kinematics of the thrust crank drive in such a manner that, in particular, a constant speed of the door panel results and/or the maximum closing force able to be exerted on the door panel remains constant during the entire closing or opening path.

A step-down gear is preferably arranged between the electric motor and the thrust crank drive. The step-down gear enables use of an electric motor with an advantageous, commercially typical rated speed.

In the modernization or retrofitting of an elevator car with an access opening, a car door with at least one door panel, which is displaceable parallel to the access opening, for closing the access opening, a thrust crank drive for moving the at least one door panel between an open setting and a closed setting as well as an electric motor for drive of the thrust crank drive, an existing control device for actuation of the electric motor is removed and replaced by a control device which is constructed in such a manner that it can so control the electric motor that a movement speed of the at least one door panel is substantially constant over the entire movement path between an open setting and a closed setting of the door panel and/or that a maximum actuation force which can be exerted by the thrust crank drive on the at least one door panel is substantially constant over the entire movement path between the open setting and the closed setting of the door panel.

The advantages of a door drive, which is modernized in that manner, of an elevator car were already explained above.

According to one of the forms of embodiment of the invention it is provided that an existing electric motor is removed and a new electric motor is installed. A new electric motor can be required in order to ensure faultless co-operation between the newly installed control device and the electric motor. The control device can comprise, for example, a frequency converter or a direct-current regulating device for control or regulation of the rotational speed and/or the torque of the electric motor.

In a further embodiment of the invention a speed measuring device for detection of a movement speed of at least one door panel is preferably also installed in the course of the modernization.

Alternatively to or in combination with the speed measuring device an angle measuring device for detection of at least one angular position of at least one component of the thrust crank drive can preferably be installed.

DESCRIPTION OF THE DRAWINGS

The above as well as further features, advantages and possibilities of use of the invention are explained in more detail from the following description of a preferred, non-limiting exemplifying embodiment with reference to the accompanying drawing, in which:

FIG. 1 shows an elevator car of an elevator with a mechanism for opening and closing a car door, in schematic illustration.

DETAILED DESCRIPTION OF THE INVENTION

An elevator car 1 with an access opening 11 is shown in FIG. 1 in the manner of a detail and in simplified form. The access opening 11 is closed by a car door. The car door has two door panels 10 which are displaceable parallel to the access opening 11 by a door drive 15. In that case the door panels 10 are so suspended at a door suspension 12 by way of guide rollers that they are displaceable axially along a guide rail 14. The guide rail 14 is fixedly arranged at a support plate 16 of the elevator car.

The door drive 15 is arranged substantially on the support plate 16 and comprises an electric motor 22 as well as a thrust crank drive. The thrust crank drive substantially comprises a crank wheel 18 as well as a respective connecting arm 24, door drive arm 26 and coupling lever 28 for each of the door panels 10. The electric motor 22 is controlled by a control device 32 and drives the crank wheel 18 of the thrust crank drive with interposition of a step-down translation gear 20 so that the crank wheel executes half a revolution alternately in counter-clockwise sense and in clockwise sense. In that case a larger belt pulley of a double-belt pulley 20.1 of the step-down gear 20 is coupled with a belt pulley 22.1 of the electric motor 22 by means of a first belt 23.1. The crank wheel 18 is coupled by means of a second belt 23.2 with a smaller belt pulley of the double-belt pulley 20.1 of the step-down gear 20.

The functioning of the thrust crank drive is described in the following, wherein the description refers to only one side of the thrust crank drive, which is associated with the door panel illustrated on the left.

The connecting arm 24 of the thrust crank drive is mounted on the crank wheel 18 to be articulated at its first end. A half revolution of the crank wheel 18 produces a substantially horizontal displacement of the connecting arm 24. The thrust crank drive further comprises a door drive arm 26 which is mounted to be stationary in relative terms, but rotatable about an axis 30 of rotation, on the support plate 16. The axis 30 of rotation of the door drive arm 26 is arranged between the first end thereof and the second end thereof. The door drive arm 26 is pivotably connected at its upper end with a second end of the connecting arm 24. A lower end of the door drive arm 26 is pivotably connected with a first end of a coupling lever 28, the second end of which is pivotably mounted on a door panel 10. A rotational movement of the drive output shaft of the electric motor 22 produces by way of the drive pulley 22.1 thereof and the first belt 23.1 a rotational movement of the double-belt pulley 20.1 of the step-down gear 20. A reduced rate of rotational movement, which is, however, provided with higher torque, of the crank wheel 18 is produced by way of the smaller belt pulley of the double-belt pulley 20.1 and the second belt 23.2. In the situation, which is shown in FIG. 1, of the components of the thrust crank drive a rotation of the crank wheel 18 in counter-clockwise sense produces a displacement of the connecting arm 24 to the right. This has the consequence that the door drive arm 26 drivingly connected with the connecting arm 24 executes a movement in clockwise sense about the axis 30 of rotation. This produces a movement of the lower end of the door drive arm 26 to the left, whereby—transmitted by the coupling lever 28—the door panel 10 is similarly moved to the left, i.e. brought into open setting. It is apparent that due to the larger spacing of the second end of the door drive arm 26 from the axis 30 of rotation by comparison with the spacing of the first end of the door drive arm 26 from the axis 30 of rotation the movement executed by the connecting arm 24 to the right is increased so that the door panel is moved further to the left than the connecting arm 24 is moved to the right.

It is also apparent that a uniform rotation of the drive output shaft of the electric motor 22 has the consequence of a non-linear movement of the door panel 10, wherein the non-linearity is caused by the translation ratios, which vary in dependence on the instantaneous setting of the thrust crank drive. In order, nevertheless, to keep substantially constant the speed of movement of the door panel 10 over the entire movement path between the closed setting and the open setting a control device 32 is provided which controls the electric motor 22 in such a manner that the desired constant movement speed of the door panel 10 is achieved.

For this purpose the control device 32 issues a rotational speed target value which changes in the course of the movement of the door panel and is formed in such a manner that a substantially constant movement speed over the entire movement path of the door panel 10 is ensured. For that purpose the control device comprises, for example, a memory device 34 in which a rotational speed plot for the electric motor is stored. This stored and predetermined rotational speed plot produces—produced by the thrust crank drive and the step-down gear—a substantially constant movement of the door panel.

If, for example, the electric motor is constructed as a direct current motor the control device 32 can comprise an evaluating device 36 which, for example, detects departures of the armature voltage or the armature amperage present at the electric motor 22 from a predetermined or optimum target value. Provided at the electric motor 22 for detection of these motor variables are separate sensor means (not illustrated) which are connected with the evaluating device by means of a communications line (not illustrated).

If defined deviations were ascertained by the evaluating device 36 the control device 32 can accelerate, decelerate, stop and/or reverse the movement of the door panel 10 in that it so controls the electric motor 22 that the requisite change of movement of the electric motor 22 results.

Moreover, a speed measuring device 40 can be provided, for example, in the form of a travel measuring sensor which with consideration of the time covered serves for determination of the movement speed of the at least one door panel 10. This speed measuring device 40 checks whether the desired movement profile of the door panel 10 is actually achieved. It can also serve as, in particular, an actual value feedback for a rotational speed regulation, which is described further below, of the electric motor 22.

Moreover, an angle measuring device 42 can be provided additionally or alternatively to the speed measuring device 40, for example in the form of an angle measuring instrument or incremental coder. This angle measuring device 42 can record an angular position of the crank wheel 18 and/or of the door drive arm 26. Conclusions about the instantaneous setting-dependent translation ratios of the thrust crank drive are possible from this angular position.

The control device 32 further comprises a regulator 38 as an adaptation device. The regulator 38 can ascertain, for example with the help of the travel measurement sensor 40, deviations of the actual movement speed from a target movement speed and, if the electric motor is present in the form of, for example, a direct current motor, appropriately adapt the armature amperage of the electric motor 22 in order to move the door panels 10 at the desired speed.

The foregoing description assumes that a regulable direct current motor in combination with a corresponding direct-current regulating apparatus is used as electric motor. Equally, the invention can be advantageously realized with a three-phase current motor, the rotational speed of which is controlled with the help of a frequency converter. In that case the movement sequence can, for example, be controlled in travel-dependent manner on the basis of a stored target movement profile. A precisely controllable movement sequence is achievable if the rotational speed control is carried out by means of a frequency converter in dependence on the feedback of the instantaneously present setting of an element of the thrust crank drive (angle measurement).

For modernization of an elevator car, individual components of the car to be modified can be demounted and replaced by components which were mentioned within the scope of the above description. Within the scope of the modernization it is also possible to install individual components without previously appropriate components being demounted.

Coming into particular consideration as new components to be installed are one or more of the following components: the electric motor 22, the control device 32, the evaluating device 36, the regulator 38, the travel measuring sensor 40 and the angle measuring instrument 42.

The above-described door panel drive can on the one hand be used in new elevator cars, but is of advantage particularly in the case of modernization of existing elevator cars with a thrust crank drive. In the case of modernization, the advantages of the thrust crank drive such as, in particular, the defined end positions and the simple and economic construction can be maintained and on the other hand the most favorable behavior of a linear drive simulated which enables the shortest closing times and opening times with substantially constant speed of movement of the door panels. In other words, in the case of an existing elevator car with a conventional thrust crank drive the complete door drive is not exchanged, but the existing thrust crank drive is modernized with an improved drive control.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car with an access opening, a car door for closing the access opening, the car door having at least one door panel displaceable parallel to the access opening, a thrust crank drive for moving the at least one door panel between an open setting and a closed setting, an electric motor for driving the thrust crank drive, and a control device for controlling the electric motor, comprising:

the control device being programmable and connected to the electric motor and controlling operation of the electric motor by determination of an instantaneous motor rotational speed and/or an instantaneous motor torque of the electric motor and including kinematics of the thrust crank drive to generate a movement speed of the at least one door panel and to vary the instantaneous motor rotational speed and/or the instantaneous motor torque of the electric motor to maintain the movement speed substantially constant over an entire movement path between the open setting and the closed setting of the door panel.

2. The elevator car according to claim 1 wherein the control device controls the electric motor to generate a maximum actuation force exerted by the thrust crank drive on the at least one door panel that is substantially constant over the entire movement path between the open setting and the closed setting of the door panel.

3. The elevator car according to claim 1 wherein the control device includes a memory device storing a predetermined rotational speed plot for the electric motor over the entire movement path between the open setting and the closed setting of the door panel.

4. The elevator car according to claim 3 wherein the control device includes an evaluating device detecting a deviation between an actual motor variable and a motor variable required for the predetermined rotational speed plot.

5. The elevator car according to claim 4 wherein the control device performs at least one of stopping and reversing the movement of the door panel in response to detecting the deviation.

6. The elevator car according to claim 1 wherein the control device includes a memory device storing changing translation ratios of the thrust crank drive over the entire movement path between the open setting and the closed setting of the door panel.

7. The elevator car according to claim 1 including a speed measuring device detecting a movement speed of the at least one door panel.

8. The elevator car according to claim 7 wherein the control device includes a regulator for adaptation of a predetermined rotational speed plot for the electric motor during operation of the elevator car on the basis of the detected movement speed of the at least one door panel.

9. The elevator car according to claim 1 including an angle measuring device detecting at least one angular position of at least one component of the thrust crank drive.

10. The elevator car according to claim 9 wherein the control device regulates at least one of the motor torque and the motor rotational speed of the electric motor in dependence on the angular position detected by the angle measuring device.

11. The elevator car according to claim 1 including a step-down translation gear coupled between the electric motor and the thrust crank drive.

12. A method of modernizing an elevator car having an access opening, a car door for closing the access opening, which door includes at least one door panel displaceable parallel to the access opening, a thrust crank drive for moving the at least one door panel between an open setting and a closed setting, and an electric motor for driving the thrust crank drive, comprising the steps of:

installing a programmable control device;

connecting the control device to the electric motor and operating the control device to determine an instantaneous motor rotational speed and/or an instantaneous motor torque of the electric motor; and operating the control device to control the electric motor to a) generate a movement speed of the at least one door panel that is substantially constant over an entire movement path between the open setting and the closed setting of the door panel by varying the instantaneous motor rotational speed and/or the instantaneous motor torque of the electric motor to maintain the movement speed and b) generate a maximum actuation force exerted by the thrust crank drive on the at least one door panel that is substantially constant over the entire movement path between the open setting and the closed setting of the door panel.

13. The method according to claim 12 including removing the electric motor and installing a new electric motor coupled with the control device.

14. The method according to claim 12 including providing a frequency converter for control of the electric motor.

15. The method according to claim 12 including providing a speed measuring device for detection of a movement speed of the at least one door panel and coupling the speed measuring device with the control device.

16. The method according to claim 12 including providing an angle measuring device for detection of at least one angular position of at least one component of the thrust crank drive and coupling the angle measuring device with the control device.

* * * * *